US009486682B2

(12) United States Patent
Daugard

(10) Patent No.: US 9,486,682 B2
(45) Date of Patent: Nov. 8, 2016

(54) BALL GAME

(71) Applicant: Craig Daugard, La Quinta, CA (US)

(72) Inventor: Craig Daugard, La Quinta, CA (US)

( * ) Notice: Subject to any disclaimer, the term of this patent is extended or adjusted under 35 U.S.C. 154(b) by 11 days.

(21) Appl. No.: 14/247,920

(22) Filed: Apr. 8, 2014

(65) Prior Publication Data

US 2015/0283444 A1 Oct. 8, 2015

(51) Int. Cl.

*A63B 69/00* (2006.01)
*A63B 71/06* (2006.01)
*A63B 43/00* (2006.01)

(52) U.S. Cl.

CPC ..... *A63B 69/0002* (2013.01); *A63B 43/007* (2013.01); *A63B 69/0084* (2013.01); *A63B 69/0088* (2013.01); *A63B 71/0669* (2013.01); *A63B 2069/0008* (2013.01); *A63B 2102/08* (2015.10); *A63B 2102/18* (2015.10); *A63B 2102/24* (2015.10); *A63B 2102/32* (2015.10)

(58) Field of Classification Search

CPC ..... A63B 69/00
USPC ..... 473/428, 427, 429
See application file for complete search history.

(56) References Cited

U.S. PATENT DOCUMENTS 2,680,022 A 6/1954 Walden
3,086,775 A * 4/1963 Albert ..... A63B 69/0084 473/147
3,166,317 A * 1/1965 Tumelson ..... A63B 69/0079 473/430
3,469,840 A * 9/1969 Kruzel ..... A63B 69/0084 473/428
3,630,521 A * 12/1971 Lingbeek ..... A63B 69/0084 473/426
3,754,761 A 8/1973 Pruss
3,953,028 A * 4/1976 Gowins ..... A63B 69/0084 473/428
4,342,459 A * 8/1982 Pretorius ..... A63B 69/0084 256/38
4,944,513 A * 7/1990 Zentner ..... A63B 69/0084 473/428
5,611,539 A * 3/1997 Watterson ..... A63B 61/02 273/400
6,042,491 A 3/2000 Dixon, Jr.
6,142,889 A * 11/2000 Schaubach ..... A63B 69/0079 473/415
7,033,290 B1 * 4/2006 Coldren ..... A63B 69/0002 473/422
2004/0033848 A1 2/2004 Bragg et al.
2012/0238382 A1 9/2012 Allison
2013/0116068 A1 * 5/2013 Traynor ..... A63B 69/0002 473/428
2015/0283444 A1 * 10/2015 Daugard ..... A63B 9/0002 473/428

* cited by examiner

*Primary Examiner* — Gene Kim
*Assistant Examiner* — M Chambers
(74) *Attorney, Agent, or Firm* — Grant's Law Firm; Allan Grant

(57) ABSTRACT

A system for playing a ball game. The system includes a cable and an attachment, the attachment configured to attach the cable to a stationary object. The system also includes a ball assembly, the ball assembly configured to move along the cable. The system further includes a hitting device for moving the ball assembly along the cable.

20 Claims, 10 Drawing Sheets

BALL GAME

CROSS-REFERENCE TO RELATED APPLICATIONS

Not applicable.

BACKGROUND OF THE INVENTION

Systems for simulating ball games suffer from a number of drawbacks. In particular, batting practice that replicates game conditions is especially difficult. This is because practice does not involve pitches that occur at full speed. Doing so would require a pitcher that can throw at an appropriate level. However, coaches and managers are understandably reluctant to waste their pitchers on excessive practice. I.e., pitchers are normally encouraged to save their arms for actual game conditions.

Most systems for batting practice, therefore, involve pitching machines that simulate a pitch. However, pitching machines do not, by themselves, teach good batting fundamentals. I.e., because there are variations in the flight of the ball the same swing is not repeated, lessening the impact of muscle memory. That is, the more precisely the batting motion can be repeated, the more muscle memory can allow the batter to repeat the motion without thinking about the mechanics.

In addition, ball games can be dangerous to bystanders. In particular, because the ball can move in any direction both before and after it is hit which means that if someone isn't paying attention, he/she can be hit with the ball.

Accordingly, there is need in the art for a system that can allow a batter to develop muscle memory. Further, there is a need in the art for a system that provides a controlled flight path.

BRIEF SUMMARY OF SOME EXAMPLE EMBODIMENTS

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

One example embodiment includes a system for playing a ball game. The system includes a cable and an attachment, the attachment configured to attach the cable to a stationary object. The system also includes a ball assembly, the ball assembly configured to move along the cable. The system further includes a hitting device for moving the ball assembly along the cable.

Another example embodiment includes a system for playing a ball game. The system includes a stationary object and a cable, wherein the cable is attached to the stationary object at a first end. The system additionally includes an attachment, the attachment configured to attach the cable to a stationary object. The system also includes a ball assembly, the ball assembly configured to move along the cable. The system further includes a hitting device for moving the ball assembly along the cable.

Another example embodiment includes a system for playing a ball game. The system includes a first stationary object and a second stationary object. The system moreover includes a cable, wherein the cable is attached to the first stationary object at a first end and the second stationary object at a second end. The system additionally includes an attachment, the attachment configured to attach the first end of the cable to the stationary object. The system also includes a ball assembly, the ball assembly is configured to move along the cable. The ball assembly includes a cable guide a ball attached to the cable guide and a reservoir attached to the cable guide opposite the ball. The system further includes a hitting device for moving the ball assembly along the cable.

These and other objects and features of the present invention will become more fully apparent from the following description and appended claims, or may be learned by the practice of the invention as set forth hereinafter.

BRIEF DESCRIPTION OF THE DRAWINGS

To further clarify various aspects of some example embodiments of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION OF SOME EXAMPLE EMBODIMENTS

Reference will now be made to the figures wherein like structures will be provided with like reference designations. It is understood that the figures are diagrammatic and schematic representations of some embodiments of the invention, and are not limiting of the present invention, nor are they necessarily drawn to scale.

Figure 1:
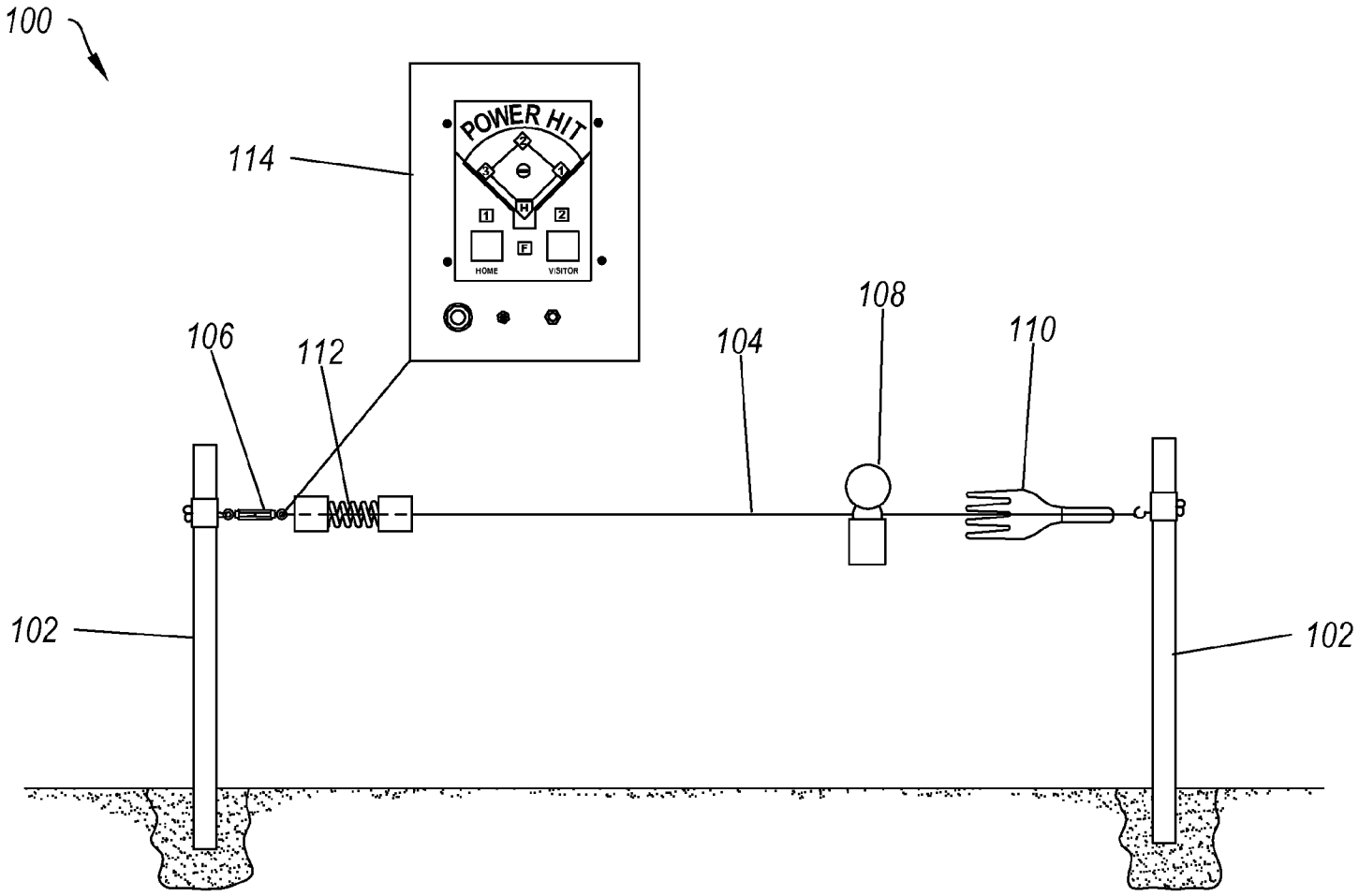
FIG. 1 illustrates an example of a system for playing a ball game.

FIG. 1 illustrates an example of a system 100 for playing a ball game. The system 100 can allow for any number of variations. For example, the system 100 can allow a user to participate in batting practice. I.e., the system 100 creates reproducible conditions, including various types of pitching, that allow a user to practice batting multiple times, creating a sense of muscle memory and allowing the user to review swinging motion. Additionally or alternatively, the system 100 can allow multiple users to participate in a game where they attempt to get a ball past one another.

FIG. 1 shows that the system 100 can include one or more stationary objects 102. For example, the stationary object 102 can include a natural object, such as a tree, or an object that is already in place, such as a pole or pillar. Additionally or alternatively, the stationary object 102 can include a temporary structure, such as a pole mounted in a stand, that can be moved as desired to a temporary location. One of skill in the art will appreciate that if more than one stationary object 102 is used, that it can include a combination of different objects.

FIG. 1 also shows that the system 100 can include a cable 104 or wire. The cable 104 is strung between the stationary objects 102. The cable 104 can include any desired material. For example, the cable 104 can include a rope or steel cable. Additionally or alternatively, the cable 104 can include an outer sheath. The outer sheath may include a material that is configured to increase or decrease the speed of the ball game, depending on user preferences. One of skill in the art will appreciate that the smoother the material that is used to make up cable 104, the higher the speeds that can be attained during a ball game, as described below. As used in the specification and the claims, the phrase "configured to" denotes an actual state of configuration that fundamentally ties recited elements to the physical characteristics of the recited structure. As a result, the phrase "configured to" reaches well beyond merely describing functional language or intended use since the phrase actively recites an actual state of configuration.

The cable 104 can be of any desired length and diameter. For example, the cable 104 can be approximately 30 feet minimum in length. A cable 104 of approximately 30 feet in length can be critical to allow for sufficient space between the stationary objects 102 for the user to comfortably swing a bat or racket. Additionally or alternatively, the cable 104 can have a diameter of approximately ⅜ inches. A cable 104 of approximately ⅜ inches in diameter can be critical to allow objects to be mounted on the cable 104, as described below. The thicker the cable, the less vibration is induced, and the faster the ball assembly can be moved along the cable. As used in the specification and the claims, the term approximately shall mean that the value is within 10% of the stated value, unless otherwise specified.

FIG. 1 further shows that the system 100 can include an attachment 106. The attachment 106 is configured to secure the cable 104 to a stationary object 102. In particular, the attachment 106 can allow the user to change the tension on the cable 104. For example, the attachment 106 can include a turnbuckle. A turnbuckle includes two threaded eye bolts, one screwed into each end of a small metal frame, one with a left-hand thread and the other with a right-hand thread. The tension can be adjusted by rotating the frame, which causes both eye bolts to be screwed in or out simultaneously, without twisting the eye bolts or attached cables. One of skill in the art will appreciate, however, that the attachment 106 can include any other mechanism for changing the tension of the cable 104, such as a ratchet, winch or other mechanism. The tighter the cable 104 is attached, the fewer vibrations induced and the higher the ball speed.

FIG. 1 additionally shows that the system 100 can include a ball assembly 108. The ball assembly 108 is configured to move along the cable 104. I.e., the cable 104 creates a controlled flight path for the ball assembly 108. However, the flight path need not be known to one or more of the users. I.e., the path of the cable 104 is known but users can change the flight path of the ball assembly 108, as described below.

FIG. 1 moreover shows that the system 100 can include racket 110. The racket 110 can be used to move the ball assembly 108 along the cable 104. In particular, the racket 110 is controlled by a user to make contract with the ball assembly 108, which moves the ball assembly 108. The racket 110 can include one or more features which make it easier to use with the system 100, as described below.

FIG. 1 also shows that the system 100 can include a rebounder 112. The rebounder 112 is configured to return the ball assembly 108 along the cable 104. That is, the ball assembly 108 moves along the cable 104, makes contact with the rebounder 112 where its flight is reversed and then returns along cable 104. The rebounder 112 can be attached near the end of the cable 104 or anywhere else along the cable 104. The rebounder 112 can include a spring or elastic material. In its most simple form, the rebounder 112 can include a spring placed around the cable 104.

FIG. 1 further shows that the system 100 can include a scoreboard 114. The scoreboard 114 is configured to help players keep track if playing a ball game. For example, if a user hits a ball into a certain portion of the cable or past another user, the first user may receive a point. The scoreboard 114 records the points scored and any other desired information. Additionally, the scoreboard 114 can measure how hard the ball assembly 108 is hit, the speed of the ball assembly 108, any spin on the ball assembly or any other characteristics of the hit or ball movement. The scoreboard 114 can then convert this data to a desired readout (such as "base hit" or "home run"). This can then be converted to a score.

Figure 2:
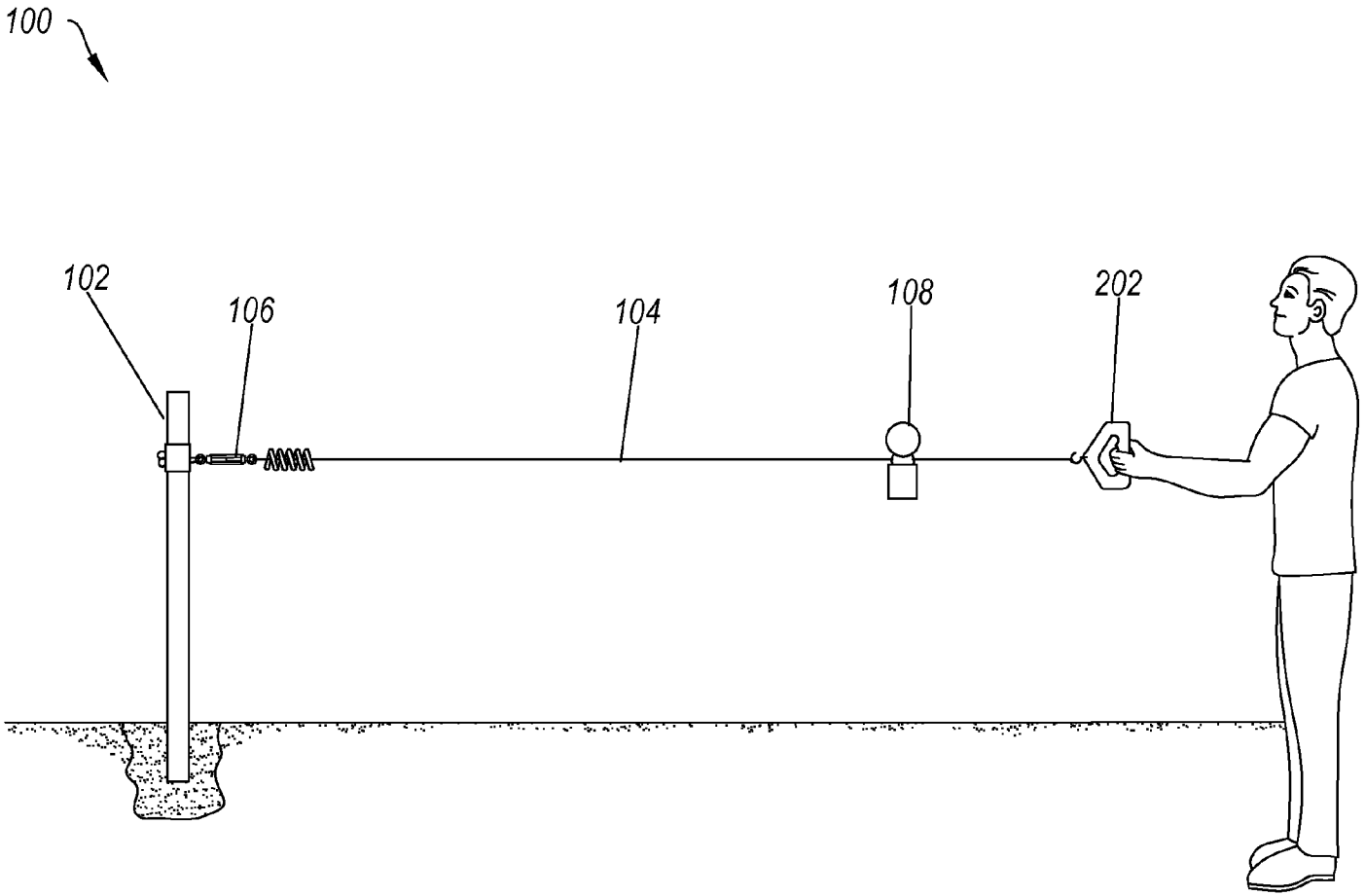
FIG. 2 illustrates an alternative example of a system for playing a ball game.

FIG. 2 illustrates an alternative example of a system 100 for playing a ball game. FIG. 2 shows that the cable 104 is connected at one end to a stationary object 102. I.e., the first end of the cable 104 is setup as shown in FIG. 1. Likewise, a ball assembly 108 is placed on the cable 104.

FIG. 2 shows that the system 100 can include a handle 202. The handle 202 is configured to attach to the cable 104 and allow a user to hold an end of the cable 104. The handle 202 can allow a user to move the end of the cable 104 opposite the attachment 106 in any direction, changing the flight path of the ball assembly 108. I.e., a user can hold the handle 202 to change the flight path of the ball assembly 108, making it more challenging for a user to make contact with the ball.

One of skill in the art will appreciate that the handle 202 can be attached at both ends. I.e., the stationary object 102 can be replaced with a handle, allowing users on both ends to change the flight path of the ball assembly 108 on the cable 104. Additionally or alternatively, the attachment of the cable 104 to the stationary object 102 can be slidable along the stationary object 102, allowing a user to provide force using the handle 202 which changes the attachment point between the cable and the stationary object 102.

Figure 3:
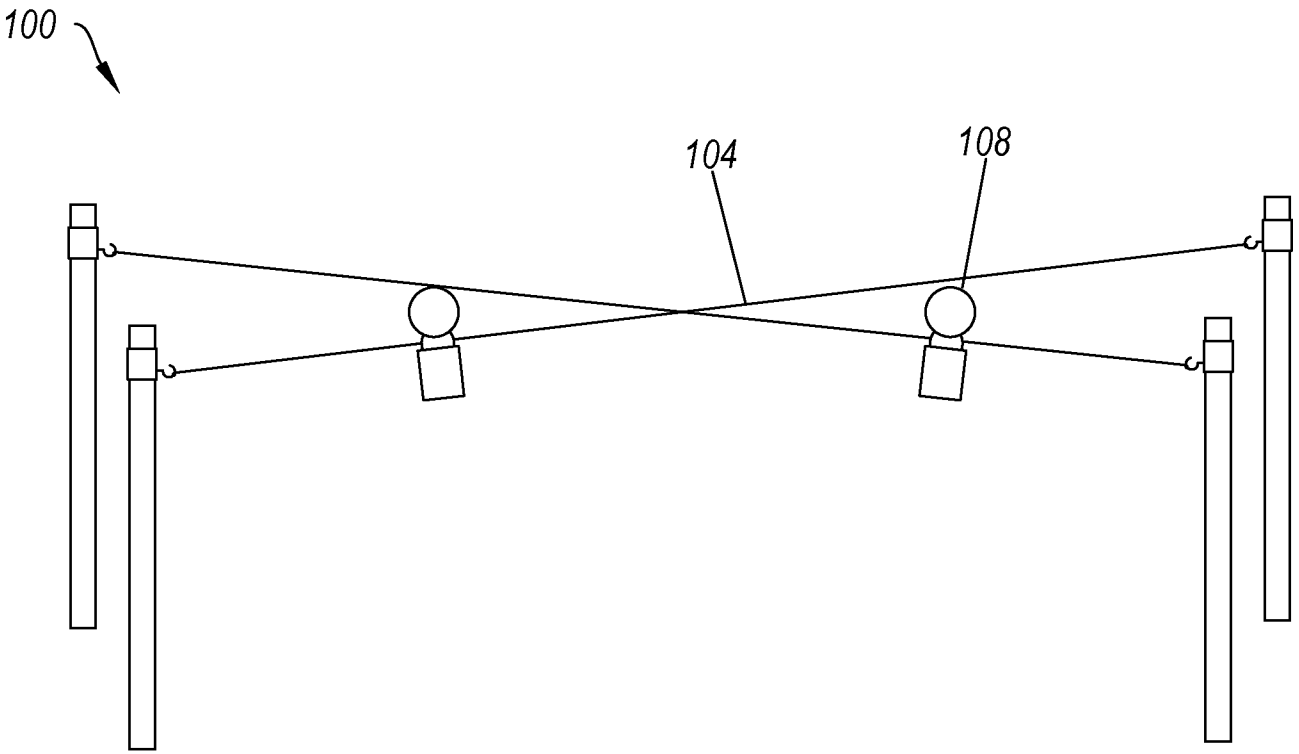
FIG. 3 illustrates a second alternative system for playing a ball game.

FIG. 3 illustrates a second alternative system 100 for playing a ball game. The system 100 includes a first cable 104 and a second cable 104 which cross each other, each with a ball assembly 108. This means that a user has to ball assemblies 108 which he she must track and/or allows for team play.

Figure 4:
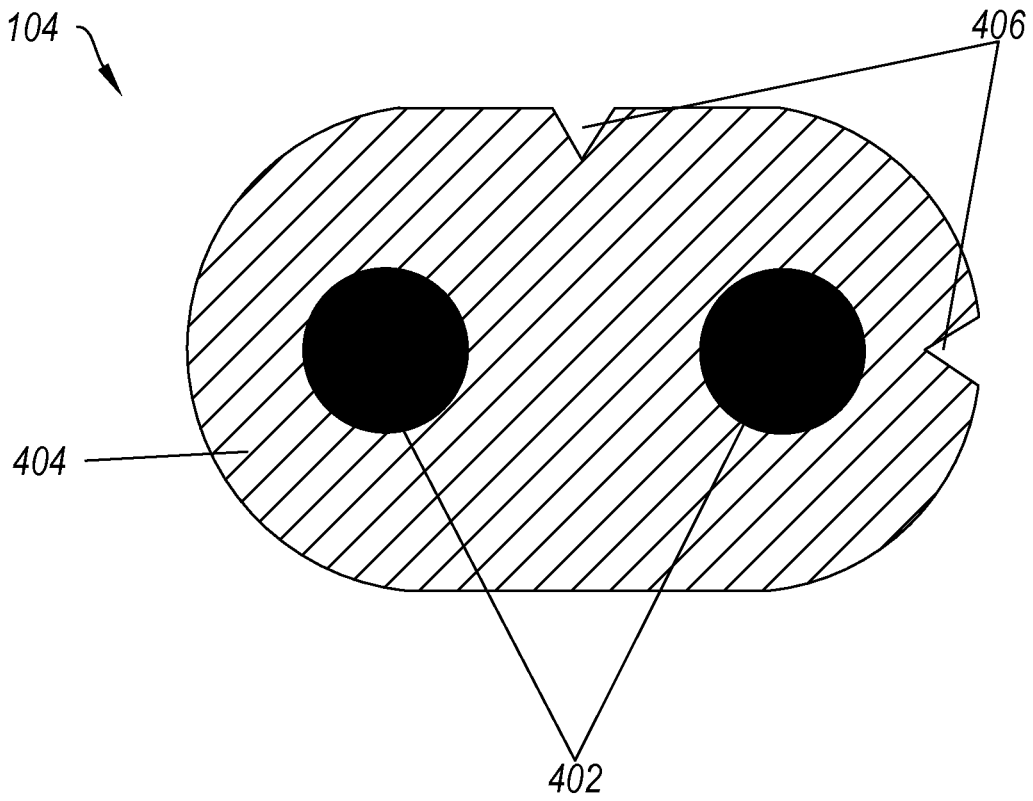
FIG. 4 illustrates an example of a cross-section of a cable.

FIG. 4 illustrates an example of a cross-section of a cable 104. The cable 104 can be configured to allow a ball assembly to move in a ball game. In particular, the cable 104 controls the movement of the ball assembly.

FIG. 4 shows that the cable 104 can include one or more cores 402. The cores 402 provide the strength of the cable 104. I.e., the cores 402 can resist the forces placed on the cable 104 during use. For example, the cores 402 can include steel or other material with a high tensile strength. The cores 402 can include a single oval shaped core 402, a single round core 402 or multiple cores 402 to provide a shape that directs the motion of the ball assembly.

FIG. 4 also shows that the cable 104 can include a sheath 404. The sheath 404 is configured to allow the ball assembly to slide along the cable 104. I.e., the one or more cores 402 can be made of a material that has a high coefficient of friction. In contrast, the sheath 404 can include a material with a low coefficient of friction, allowing the ball assembly to attain higher speeds and to slide a farther distance. For example, the sheath 404 can include plastic or any other desired material. Additionally or alternatively, the sheath 404 can be of a non-circular shape, which fixes the orientation of the cable 104 relative to the ball assembly.

FIG. 4 further shows that the sheath 404 can include one or more features 406. The features 406 eliminate the symmetry of the sheath 404 so that the ball assembly can only be placed on the cable in a single orientation. I.e., any symmetrical shape of the sheath 404 means that the ball assembly can be placed in more than one orientation relative to the cable 104. The features 406 ensure that only a single orientation can be achieved.

Figure 5A:
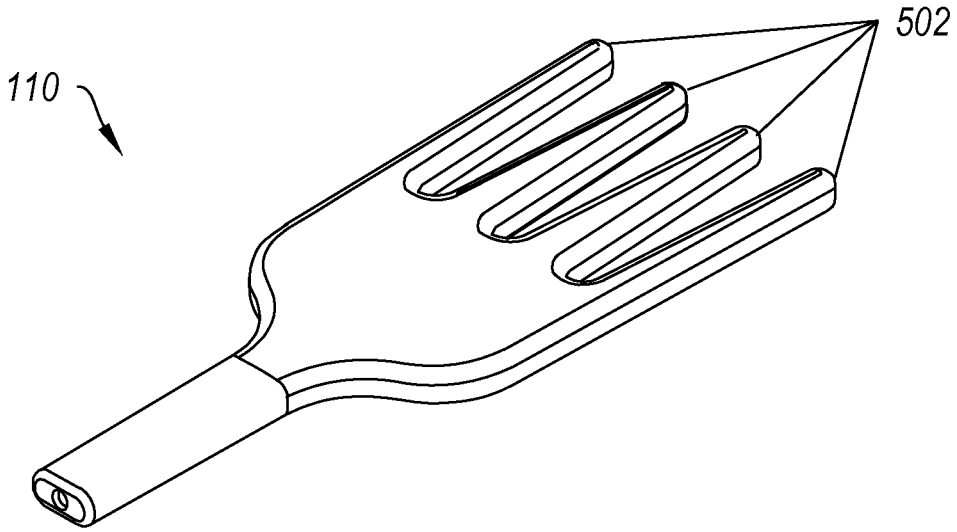
FIG. 5A illustrates a top perspective view of the example of the racket.
Figure 5B:
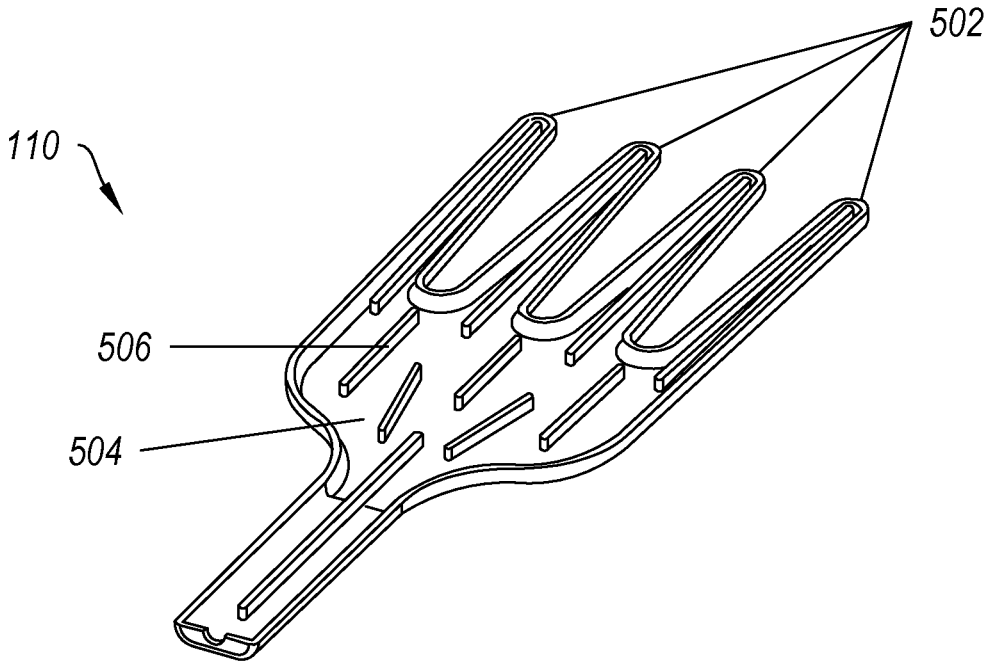
FIG. 5B illustrates a cutaway view of the example of the racket.

FIGS. 5A and 5B (collectively "FIG. 5") illustrate an example of a racket 110. FIG. 5A illustrates a top perspective view of the example of the racket 110; and FIG. 5B illustrates a cutaway view of the example of the racket 110. The racket 110 can be used in a system, such as the system 100 of FIG. 1, for playing a ball game. In particular, the racket 110 can be configured to play a game where a ball on a cable is struck, causing the ball to move along the cable.

FIG. 5 shows that the racket 110 can include two or more fingers 502. The fingers 502 can be configured to make contact with a ball mounted on a cable. In particular, the fingers 502 pass around the cable, because of the space between the fingers 502 but provide a solid mass that can make contact with the ball and propel the ball along the cable. The size of the fingers 502, and the space between fingers 502, can be critical to ensure that the racket 110 can be used to make contact with a ball mounted on a cable. For example, the fingers 502 can be approximately 5 inches long and approximately 1 inch wide at the base, narrowing to 0.5 inches wide 2 inches from the tip. Additionally or alternatively, the gap between the fingers 502 can be approximately 1 to 2 inches at the tips of the fingers 502 and 0.5 to 2 inches at the base of the fingers 502.

FIG. 5 also shows that the racket 110 can include a cavity 504. The cavity 504 is configured to hold a fill material. The fill material can add mass to the racket 110 allowing a user to strengthen his/her hands and arms as well as adding additional power to the ball when hit. The fill material can include any desired material including sand, metal shot, water or any other fill material. The racket 110 can be made of any suitable material of sufficient strength to support the fill material. For example, the racket 110 can be made of plastic or aluminum.

FIG. 5 further shows that the racket 110 can include one or more supports 506. The one or more supports 506 can be configured to strengthen the racket 110. I.e., if the fill material has a bubble or empty space near the point of impact, then the racket 110 may break or shatter, rendering it inoperable. The one or more supports 506 extend through the racket 110, strengthening the racket 110 and the fingers 502 to prevent breakage.

One of skill in the art will appreciate that the racket 110 or the fill material can include a material that is configured to produce light for night time play. For example, the racket 110 can be made of glow in the dark plastic, which absorbs light and then glows for a period of time thereafter. Additionally or alternatively, the fill material can include a glow stick or glow in the dark dye.

Figure 6:
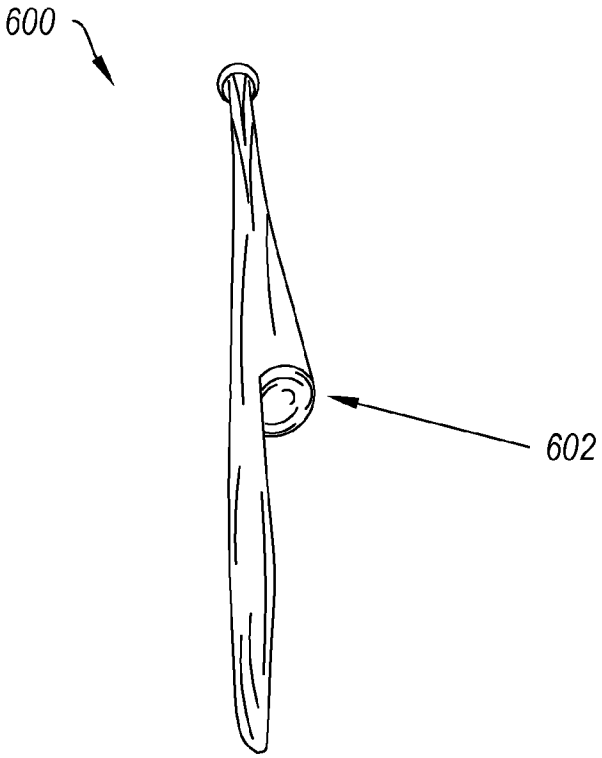
FIG. 6 illustrates an example of a bat for use with a ball game system.

FIG. 6 illustrates an example of a bat 600 for use with a ball game system, such as the system 100 of FIGS. 1-3. The bat 600 can be a standard baseball or other bat. I.e., the bat 600 can include a bat that falls within baseball regulations for the size, weight, etc. of the bat. Additionally or alternatively, the bat 600 can include a plastic bat which is hollow and can be weighted with sand, metal shot, water or any other fill material.

FIG. 6 shows that the bat 600 can include a removed section 602. The removed section 602 is a portion of the bat head that has been removed. The removed section 602 allows a user to swing and avoid contact with the cable. I.e., the removed section prevents the user from hitting the cable when swinging at the ball assembly while still hitting the ball in the correct location (approximately ⅛ inch above the center of the ball).

Figure 7:
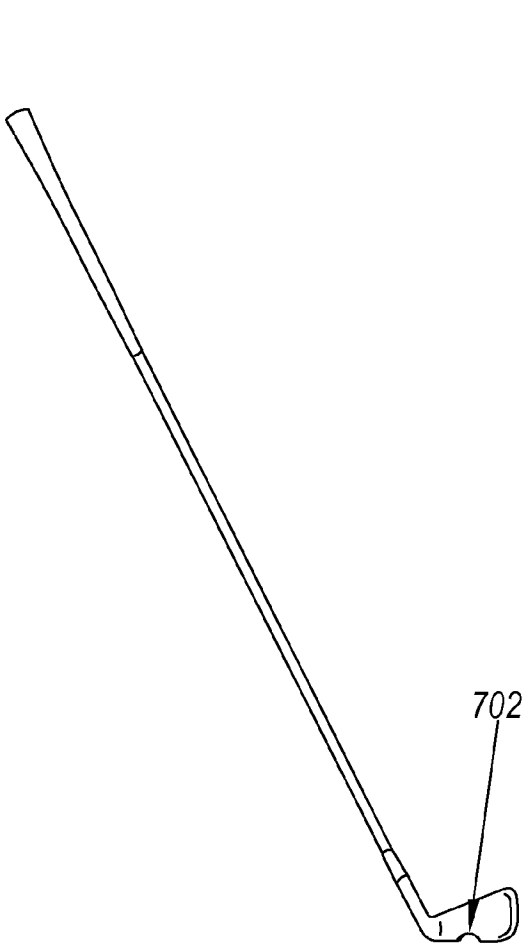
FIG. 7 illustrates an example of a golf club for use with a ball game system.

FIG. 7 illustrates an example of a golf club 700 for use with a ball game system, such as the system 100 of FIGS. 1-3. The golf club 700 can be a standard golf club. I.e., the golf club 700 can include a golf club that falls within golf regulations for the size, weight, etc. of the golf club. Additionally or alternatively, the golf club 700 can include a plastic golf club which is hollow and can be weighted with sand, metal shot, water or any other fill material.

FIG. 7 shows that the golf club 700 can include a removed section 702. The removed section 702 is a portion of the golf club head that has been removed. The removed section 702 allows a user to swing and avoid contact with the cable. I.e., the removed section prevents the user from hitting the cable when swinging at the ball assembly while still hitting the ball in the correct location.

Figure 8:
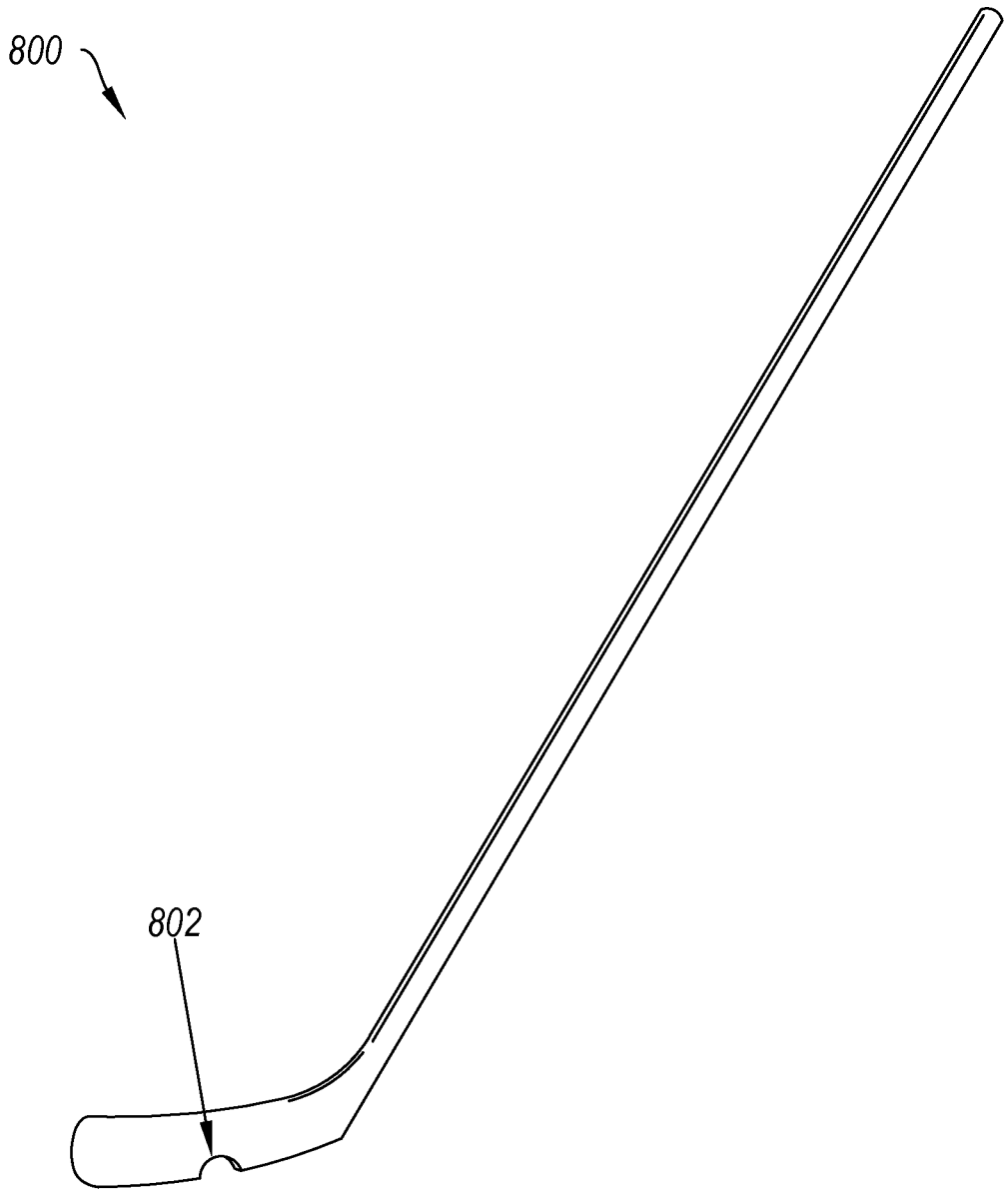
FIG. 8 illustrates an example of a hockey stick for use with a ball game system.

FIG. 8 illustrates an example of a hockey stick 800 for use with a ball game system, such as the system 100 of FIGS. 1-3. The hockey stick 800 can be a standard baseball or other hockey stick. I.e., the hockey stick 800 can include a hockey stick that falls within baseball regulations for the size, weight, etc. of the hockey stick. Additionally or alternatively, the hockey stick 800 can include a plastic hockey stick which is hollow and can be weighted with sand, metal shot, water or any other fill material. Likewise, the hockey stick 800 can include a short stick.

FIG. 8 shows that the hockey stick 800 can include a removed section 802. The removed section 802 is a portion of the hockey stick head that has been removed. The removed section 802 allows a user to swing and avoid contact with the cable. I.e., the removed section prevents the user from hitting the cable when swinging at the ball assembly while still hitting the ball in the correct location.

Figure 9A:
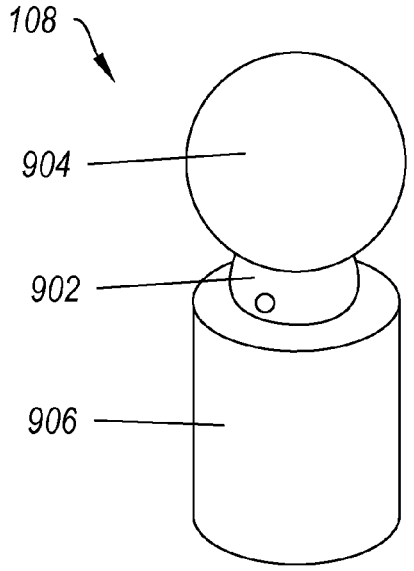
FIG. 9A illustrates a perspective view of the ball assembly.
Figure 9B:
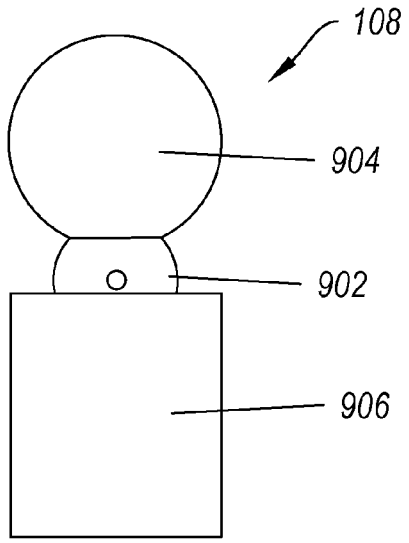
FIG. 9B illustrates a front view of the ball assembly.

FIGS. 9A and 9B (collectively "FIG. 9") illustrate an example of a ball assembly 108. FIG. 9A illustrates a perspective view of the ball assembly 108; and FIG. 9B illustrates a front view of the ball assembly 108. The ball assembly 108 is configured to move along a cable. I.e., the cable creates a controlled flight path for the ball assembly 108. However, the flight path need not be known to one or more of the users. I.e., the path of the cable is known but users can change the flight path of the ball assembly 108, as described above.

FIG. 9 shows that the ball assembly 108 can include cable guide 902. The cable guide 902 allows the ball assembly 108 to move along the cable. In particular, the cable guide 902 includes a hole that is configured to allow the cable to pass through the cable guide 902. Additionally or alternatively, the hole can be lined with a material that is configured to reduce the friction between the hole and the cable. For example, the hole can be lined with plastic or some other material. The cable through the hole allows the ball assembly 108 to move freely along the cable.

FIG. 9 also shows that the ball assembly 108 can include a ball 904. The ball 904 is the portion of the ball assembly 108 that will be hit by the user. In particular, the ball 904 can be the approximate size and shape of a baseball or softball for batting practice, of a golf ball for golf practice or of some other ball. The ball 904 is mounted on the cable guide 902 allowing the ball 904 to move above the cable, thus making the whole ball available for contact by the user. I.e., the user need not account for the cable in his/her swing since the ball is mounted above the cable guide 902, allowing for a more natural swing.

FIG. 9 further shows that the ball assembly 108 can include a reservoir 906. The reservoir 906 can be weighted to change the movement of the ball assembly 108 along the cable, change the speed of the ball assembly 108 along the cable, and/or to ensure that the ball 904 remains above the cable guide 902. I.e., the reservoir can be filled with a fill material, such as sand, metal shot, water or any other fill material, to increase the weight of the ball assembly 108. If the reservoir 906 is only partially filled, then the movement of the ball 904 may be different than if the reservoir 906 were completely filled. For example, a partially filled reservoir 906 may cause the ball assembly to "stutter" (i.e., move slower and faster) as it moves along the cable.

One of skill in the art will appreciate that the cable guide 902, the ball 904, the reservoir 906 and/or the fill material in the reservoir 906 can include a material that is configured to produce light for night time play. For example, the cable guide 902, the ball 904, the reservoir 906 can be made of glow in the dark plastic, which absorbs light and then glows for a period of time thereafter. Additionally or alternatively, the cable guide 902, the ball 904, the reservoir 906 and/or the fill material in the reservoir 906 can include a glow stick or glow in the dark dye.

Figure 10:
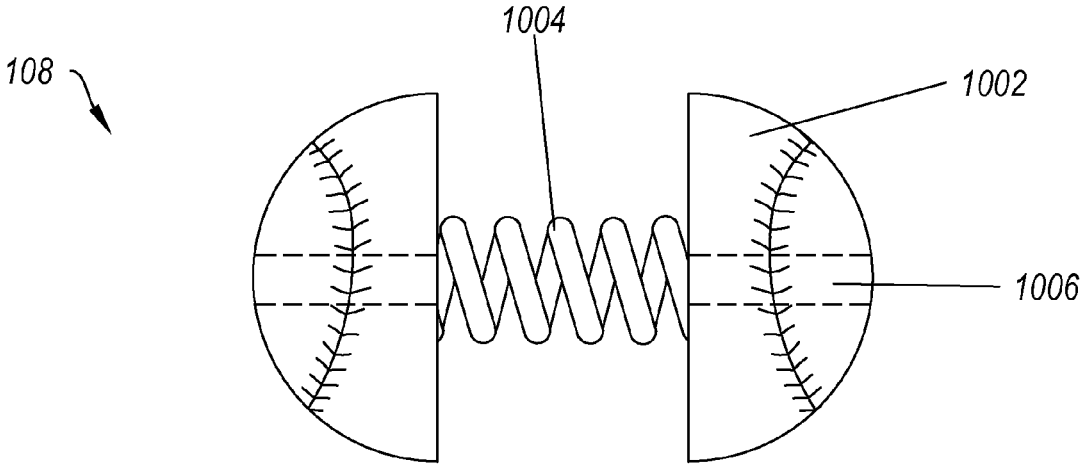
FIG. 10 illustrates an alternative example of a ball assembly.

FIG. 10 illustrates an alternative example of a ball assembly 108. The ball assembly 108 is configured to move along the cable. I.e., the cable creates a controlled flight path for the ball assembly 108. However, the flight path need not be known to one or more of the users. I.e., the path of the cable is known but users can change the flight path of the ball assembly 108, as described above.

FIG. 10 shows that the ball assembly 108 can include a ball 1002 divided into two halves perpendicular to the desired direction of travel. I.e., the ball 1002 includes two hemispheres if the ball 1002 is spherical. If the ball is an alternative shape, such as a football, then the halves may not be a hemisphere.

FIG. 10 also shows that the ball assembly 108 can include an elastic object 1004. The elastic object 1004 is configured to connect the two halves of the ball 1002 to one another. For example, the elastic object 1004 can include a spring or other apparatus. A spring is an elastic object used to store mechanical energy. When a spring is compressed or stretched, the force it exerts is proportional to its change in length.

FIG. 10 further shows that the ball assembly 108 can include a hole 1006. The hole 1006 allows the ball assembly 108 to move along the cable. In particular, the hole 1006 is configured to allow the cable to pass through the ball 1002. Additionally or alternatively, the hole 1006 can be lined with a material that is configured to reduce the friction between the hole 1006 and the cable. For example, the hole 1006 can be lined with smooth plastic or can be lubricated with a lubricating material. The cable through the hole allows the ball assembly 108 to move freely along the cable.

One of skill in the art will appreciate that the ball 1002 can include a material that is configured to produce light for night time play. For example, the ball 1002 can be made of glow in the dark plastic, which absorbs light and then glows for a period of time thereafter. Additionally or alternatively, the ball 1002 can be configured to receive a glow stick or be painted with glow in the dark dye.

Figure 11:
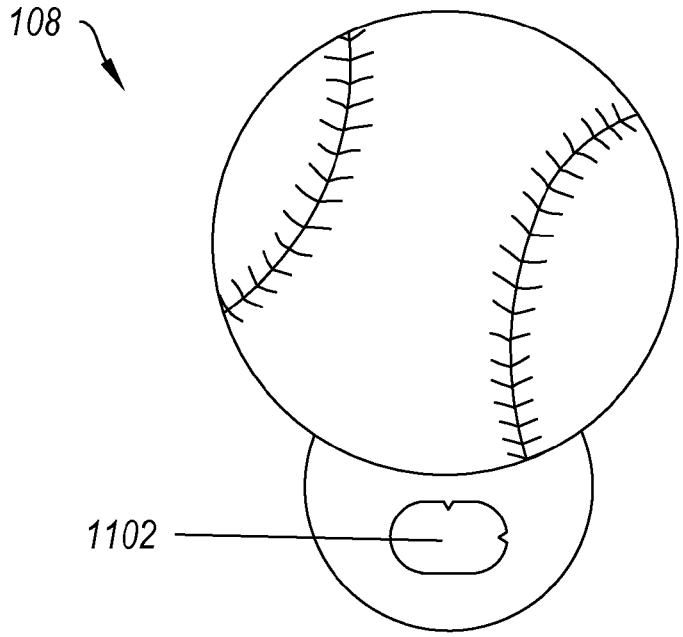
FIG. 11 illustrates an alternative example of a ball assembly.

FIG. 11 illustrates an alternative example of a ball assembly 108. In the ball assembly 108 the hole 1102 is shaped to conform to the shape of a cable. For example, if the cable has the cross-section shown in FIG. 4 the hole 1102 can be a complimentary shape to create a single possible orientation between the ball assembly 108 and the cable. One of skill in the art will appreciate that restricting the orientation of the ball assembly 108 relative to the cable need not restrict the ball assembly 108 to a single orientation when moved. For example, if the cable includes a twist, the ball assembly 108 will move in concert with the twist of the cable.

Figure 12:
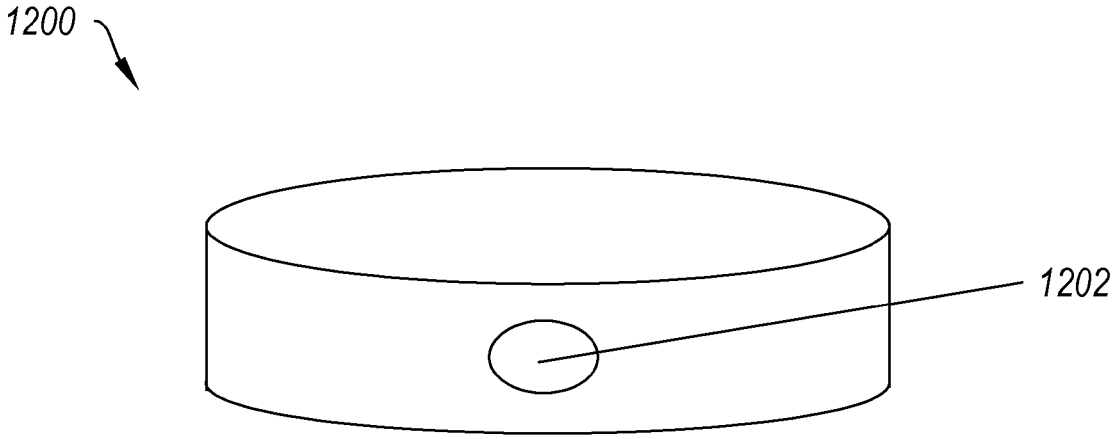
FIG. 12 illustrates an example of a puck assembly.

FIG. 12 illustrates an example of a puck assembly 1200. The puck assembly 1200 includes a hole 1202, allowing the puck assembly 1200 to move along the cable. In particular, the hole 1202 is configured to allow the cable to pass through the hole 1200. Additionally or alternatively, the hole 1202 can be lined with a material that is configured to reduce the friction between the hole and the cable. For example, the hole can be lined with plastic or some other material. The cable through the hole allows the puck assembly 1200 to move freely along the cable.

The puck assembly 1200 can also include a cavity. The cavity is configured to hold a fill material. The fill material can add mass to the puck assembly 1200 allowing a user to strengthen his/her hands and arms as well as adding additional power to the ball when hit. The fill material can include any desired material including sand, metal shot, water or any other fill material. The puck assembly 1200 can be made of any suitable material of sufficient strength to support the fill material. For example, the puck assembly 1200 can be made of plastic or aluminum.

Figure 13:
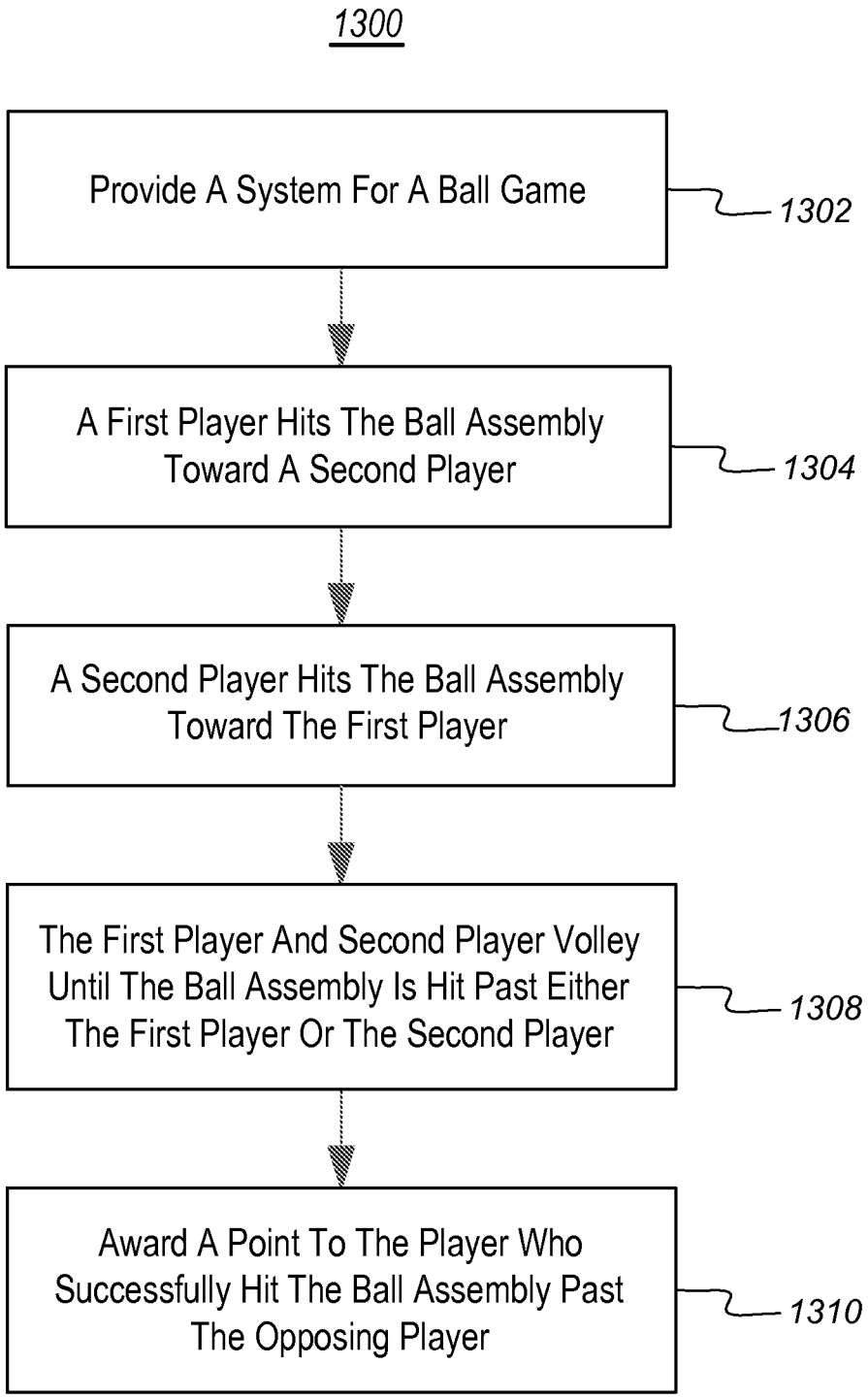
FIG. 13 is a flow chart illustrating a method of playing a ball game.

FIG. 13 is a flow chart illustrating a method 1300 of playing a ball game. In at least one implementation, the ball game can be played on a system, such as the system 100 of FIGS. 1-3. Therefore, the method 1300 will be described, exemplarily, with reference to the system 100 of FIGS. 1-3. Nevertheless, one of skill in the art can appreciate that the method 1300 can be used to play a ball game on a system other than the system 100 of FIGS. 1-3.

FIG. 13 shows that the method 1300 includes providing 1302 a system for a ball game. The system can allow for any number of variations. For example, the system can allow a user to participate in batting practice. I.e., the system creates reproducible conditions, including various types of pitching, that allow a user to practice batting multiple times, creating a sense of muscle memory and allowing the user to review swinging motion. Additionally or alternatively, the system can allow multiple users to participate in a game where they attempt to get a ball past one another.

The system can include one or more stationary objects. For example, the stationary object can include a natural object, such as a tree, or an object that is already in place, such as a pole or pillar. Additionally or alternatively, the stationary object can include a temporary structure, such as a pole mounted in a stand, that can be moved as desired to a temporary location. One of skill in the art will appreciate that if more than one stationary object is used, that it can include a combination of different objects.

The system can also include a cable. The cable is strung between the stationary objects. The cable can include any desired material. For example, the cable can include a rope or steel cable. Additionally or alternatively, the cable can include an outer sheath. The outer sheath may include a material that is configured to increase or decrease the speed of the ball game, depending on user preferences. One of skill in the art will appreciate that the smoother the material that is used to make up cable, the higher the speeds that can be attained during a ball game, as described below.

The cable can be of any desired length and diameter. For example, the cable can be approximately 30 feet minimum in length. A cable of approximately 30 feet minimum in length can be critical to allow for sufficient space between the stationary objects for the user to comfortably swing a bat or racket. Additionally or alternatively, the cable can have a diameter of approximately ⅜ inches. A cable of approximately ⅜ inches in diameter can be critical to allow objects to be mounted on the cable and will prevent excessive vibration, as described below.

Alternatively, the cable includes a first portion which provides alternate flight paths for the ball assembly on a first end of the cable. That is the first portion includes cables that allow the ball assembly to take multiple paths, making the path of the ball assembly more unpredictable. Likewise, a second portion can provide alternate flight paths on the second end of the cable.

The system can further include an attachment. The attachment is configured to secure the cable to a stationary object. In particular, the attachment can allow the user to change the tension on the cable. For example, the attachment can include a turnbuckle. A turnbuckle includes two threaded eye bolts, one screwed into each end of a small metal frame, one with a left-hand thread and the other with a right-hand thread. The tension can be adjusted by rotating the frame, which causes both eye bolts to be screwed in or out simultaneously, without twisting the eye bolts or attached cables. One of skill in the art will appreciate, however, that the attachment can include any other mechanism for changing the tension of the cable, such as a ratchet, winch or other mechanism. The tighter the cable is attached, the fewer vibrations induced and the higher the ball speed.

The system can additionally include a ball assembly. The ball assembly is configured to move along the cable. I.e., the cable creates a controlled flight path for the ball assembly. However, the flight path need not be known to one or more of the users. I.e., the path of the cable is known but users can change the flight path of the ball assembly, as described below.

The ball assembly can include cable guide. The cable guide allows the ball assembly to move along the cable. In particular, the cable guide includes a hole that is configured to allow the cable to pass through the cable guide. Additionally or alternatively, the hole can be lined with a material that is configured to reduce the friction between the hole and the cable. For example, the hole can be lined with smooth plastic. The cable through the hole allows the ball assembly to move freely along the cable.

The ball assembly can also include a ball. The ball is the portion of the ball assembly that will be hit by the user. In particular, the ball can be the approximate size and shape of a baseball or softball for batting practice, of a golf ball for golf practice or of some other ball or puck. The ball is mounted on the cable guide allowing the ball to move above the cable, thus making the whole ball available for contact by the user. I.e., the user need not account for the cable in his/her swing since the ball is mounted above the cable guide, allowing for a more natural swing.

The ball assembly can further include a reservoir. The reservoir can be weighted to change the movement of the ball assembly along the cable, change the speed of the ball assembly along the cable, and/or to ensure that the ball remains above the cable guide and does not rock back and forth horizontally perpendicular to the cable. I.e., the reservoir can be filled with a fill material, such as sand, metal shot, water or any other fill material, to increase the weight of the ball assembly. If the reservoir is only partially filled, then the movement of the ball may be different than if the reservoir were completely filled. For example, a partially filled reservoir may cause the ball assembly to "stutter" (i.e., move slower and faster) as it moves along the cable.

One of skill in the art will appreciate that any equipment including the cable guide, the ball, the reservoir and/or the fill material in the reservoir can include a material that is configured to produce light for night time play. For example, any equipment including the cable guide, the ball, the reservoir can be made of glow in the dark plastic, which absorbs light and then glows for a period of time thereafter. Additionally or alternatively, any equipment including the cable guide, the ball, the reservoir and/or the fill material in the reservoir can include a glow stick or glow in the dark dye.

Alternatively, the ball assembly can include a ball divided into two halves perpendicular to the desired direction of travel. I.e., the ball includes two hemispheres if the ball is spherical.

The ball assembly can also include an elastic object. The elastic object is configured to connect the two halves of the ball to one another. For example, the elastic object can include a spring or other apparatus. A spring is an elastic object used to store mechanical energy. When a spring is compressed or stretched, the force it exerts is proportional to its change in length.

The ball assembly can further include a hole. The hole allows the ball assembly to move along the cable. In particular, the hole is configured to allow the cable to pass through the ball. Additionally or alternatively, the hole can be lined with a material that is configured to reduce the friction between the hole and the cable. For example, the hole can be lined with smooth plastic. The cable through the hole allows the ball assembly to move freely along the cable.

One of skill in the art will appreciate that the ball can include a material that is configured to produce light for night time play. For example, the ball can be made of glow in the dark plastic, which absorbs light and then glows for a period of time thereafter. Additionally or alternatively, the ball can be configured to receive a glow stick or be painted with glow in the dark dye.

The system moreover can include racket. The racket can be used to move the ball assembly along the cable. In particular, the racket is controlled by a user to make contract with the ball assembly, which moves the ball assembly. The racket can include one or more features which make it easier to use with the system, as described below. Rackets can be used to play two handed on single handed and with the rebounder a player may practice alone.

The racket can include two or more fingers. The fingers can be configured to make contact with a ball mounted on a cable. In particular, the fingers pass around the cable, because of the space between fingers but provide a solid mass that can make contact with the ball and propel the ball along the cable. The size of the fingers, and the space between fingers, can be critical to ensure that the racket can be used to make contact with a ball mounted on a cable. For example, the fingers can be approximately 5 inches long and approximately 1 inch wide at the base, narrowing to 0.5 inches wide 2 inches from the tip. Additionally or alternatively, the gap between the fingers can be approximately 1 to 2 inches at the tips of the fingers and 0.5 to 2 inches at the base of the fingers.

The racket can also include a cavity. The cavity is configured to hold a fill material. The fill material can add mass to the racket allowing a user to strengthen his/her hands and arms as well as adding additional power to the ball when hit. The fill material can include any desired material including sand, metal shot, water or any other fill material. The racket can be made of any suitable material of sufficient strength to support the fill material. For example, the racket can be made of plastic or aluminum. Fill material can make the racket harder to swing but makes the ball assembly move faster when hit. Therefore, a less experienced player can use medium weighting and a more experienced player can use a heavier or lighter racket, to equalize playing abilities. Additionally or alternatively, a player can use more fill material to increase the weight and provide a more strenuous workout.

The racket can further include one or more supports. The one or more supports can be configured to strengthen the racket. I.e., if the fill material has a bubble or empty space near the point of impact, then the racket may break or shatter, rendering it inoperable. The one or more supports extend through the racket, strengthening the racket and the fingers to prevent breakage.

One of skill in the art will appreciate that the racket or the fill material can include a material that is configured to produce light for night time play. For example, the racket can be made of glow in the dark plastic, which absorbs light and then glows for a period of time thereafter. Additionally or alternatively, the fill material can include a glow stick or glow in the dark dye.

The system can also include a rebounder. The rebounder is configured to return the ball assembly along the cable. That is, the ball assembly moves along the cable, makes contact with the rebounder where its flight is reversed and then returns along cable. The rebounder can be attached near the end of the cable or anywhere else along the cable. The rebounder can include a spring or elastic material. One of skill in the art will appreciate that the rebounder not be used with a ball that can self-return, such as the spring ball disclosed above.

Alternatively, the system can include a handle. The handle is configured to attach to the cable and allow a user to hold an end of the cable. The handle can allow a user to move the end of the cable opposite the attachment in any direction, changing the flight path of the ball assembly. I.e., a user can hold the handle to change the flight path of the ball assembly, making it more challenging for a user to make contact with the ball. For example, the user can raise use the handles to create sliders, curve balls, etc.

One of skill in the art will appreciate that the handle can be attached at both ends. I.e., the stationary object can be replaced with a handle, allowing users on both ends to change the flight path of the ball assembly on the cable. Additionally or alternatively, the attachment of the cable to the stationary object can be slidable along the stationary object, allowing a user to provide force using the handle which changes the attachment point between the cable and the stationary object.

FIG. 13 also shows that the method 1300 can include a first player hitting 1304 the ball assembly toward a second player. In particular, the first player hits 1304 the ball assembly along the cable using a racket. This would be a serve that starts the ball assembly in play. I.e., when the first player hits 1304 the ball assembly a point has begun.

FIG. 13 further shows that the method 1300 can include a second player hitting 1306 the ball assembly toward the first player. In particular, the second player hits 1306 the ball assembly along the cable using a racket. This is a return the keeps the ball assembly in play. I.e., a successful return by the second player means that play for the point continues.

FIG. 13 additionally shows that the method 1300 can include the first player and the second player volleying 1308 until the ball assembly is hit past either the first player or the second player or stopped on his/her end of the cable. I.e., the first player and the second player continue to hit the ball assembly as long as it has not been hit past either player or stopped on his/her end of the cable. Variations can be played or mandated, such as players being required to hit with alternate hands (i.e., hitting with a racket in the left hand for one hit and hitting with a second racket in the right hand for a subsequent hit) or allowing the players to move toward or away from the center of the cable. Further, a portion of the cable may be designated as a "goal" into which the ball assembly must pass in order for a player to receive a point.

Additionally or alternatively, a third player can be added as a teammate for the first player and a fourth player can be added as a teammate for the second player. Teammates may be required to alternate hitting the ball assembly or may both be eligible to hit the ball assembly. E.g., the first player may be closer to the center of the cable and if the first player is unable to hit the ball assembly, the third player may hit the ball assembly.

FIG. 13 moreover shows that method 1300 can include awarding 1308 a point to the player who successfully hit the ball assembly past the opposing player or stopped on his/her end of the cable. I.e., when a player hits the ball assembly past the opposing player (or into the portion of the cable that is designated as a "goal" if applicable) is awarded a point. The game can continue until a player receives a set number of points or until a certain amount of time has expired with the player with most points winning the game.

One skilled in the art will appreciate that, for this and other processes and methods disclosed herein, the functions performed in the processes and methods may be implemented in differing order. Furthermore, the outlined steps and operations are only provided as examples, and some of the steps and operations may be optional, combined into fewer steps and operations, or expanded into additional steps and operations without detracting from the essence of the disclosed embodiments.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A system for playing a ball game, the system comprising:

a cable;

an attachment, the attachment configured to attach the cable to a stationary object;

a ball assembly is configured to move along the cable, wherein the ball assembly includes:

a cable guide;

a ball attached to the cable guide;

a reservoir attached to the cable guide opposite the ball, wherein the reservoir is used to ensure the ball remains above the cable; and a hitting device for moving the ball assembly along the cable and wherein said reservior is removable from said cable guide and includes a cavity to hold fill material.

2. The system of claim 1, wherein the hitting device includes a racket.

3. The system of claim 2, wherein the racket includes two or more fingers.

4. The system of claim 2, wherein the racket includes a cavity configured to hold a fill material.

5. The system of claim 2, wherein the racket includes one or more supports configured to strengthen the racket against failure during impact with the racket.

6. The system of claim 2, wherein the racket includes a glow in the dark plastic.

7. The system of claim 1, wherein the stationary object includes a pole.

8. The system of claim 1, wherein the stationary object includes a tree.

9. The system of claim 1, wherein the stationary object includes a stand.

10. The system of claim 1, wherein the cable includes an outer sheath configured to increase the speed of the ball assembly.

11. The system of claim 1, wherein the cable includes a steel cable.

12. The system of claim 1, wherein the hitting device includes a bat with a portion of the head removed.

13. A system for playing a ball game, the system comprising:

a stationary object;

a cable, wherein the cable is attached to the stationary object at a first end;

an attachment, the attachment configured to attach the cable to the stationary object;

a ball assembly is configured to move along the cable, wherein the ball assembly includes:

a cable guide;

a ball attached to the cable guide;

a reservoir attached to the cable guide opposite the ball, wherein the reservoir is used to ensure the ball remains above the cable; and a hitting device for moving the ball assembly along the cable and wherin said reservoir is removable from said cable guide and includes a cavity to hold fill material.

14. The system of claim 13, wherein the ball assembly includes:

a ball divided in half, the halves of the ball connected by an elastic object.

15. The system of claim 14, wherein the elastic object includes a spring.

16. The system of claim 13, wherein the cable includes:

a first portion that defines a first flight path; and a second portion that defines a second flight path.

17. The system of claim 13 further comprising a handle on one end of the cable.

18. A system for playing a ball game, the system comprising:

a first stationary object;

a second stationary object;

a cable, wherein the cable is attached to the first stationary object at a first end and the second stationary object at a second end;

an attachment, the attachment configured to attach the first end of the cable to the stationary object;

a ball assembly, wherein the ball assembly:

is configured to move along the cable;

and includes:

a cable guide;

a ball attached to the cable guide;

a reservoir attached to the cable guide opposite the ball, wherein the reservoir is used to ensure the ball remains above the cable; and a hitting device for moving the ball assembly along the cable and wherein said reservoir is removable from said cable guide and includes a cavity to hold fill material.

19. The system of claim 18 further comprising a rebounder, the rebounder configured to return the ball assembly along the cable.

20. The system of claim 18, wherein the attachment includes a turnbuckle.

* * * * *